US006620052B2

(12) United States Patent
Piatt

(10) Patent No.: US 6,620,052 B2
(45) Date of Patent: Sep. 16, 2003

(54) GOLF-SWING TRAINING HARNESS

(76) Inventor: John Piatt, 58-141 Maika Way, Haleiwa, HI (US) 96712

( * ) Notice: Subject to any disclaimer, the term of this patent is extended or adjusted under 35 U.S.C. 154(b) by 0 days.

(21) Appl. No.: 10/051,862

(22) Filed: Jan. 16, 2002

(65) Prior Publication Data

US 2003/0134685 A1 Jul. 17, 2003

(51) Int. Cl.[7] ..... A63B 69/36
(52) U.S. Cl. ..... 473/208; 437/271
(58) Field of Search ..... 473/208, 215, 473/266, 269, 271, 274

(56) References Cited

U.S. PATENT DOCUMENTS 2,498,006 A * 2/1950 Ridill
2,528,077 A * 10/1950 Pond
2,737,432 A 3/1956 Jenks
2,893,736 A * 7/1959 Tesi
3,442,513 A 5/1969 Fisher
3,677,551 A 7/1972 Schaus
5,062,642 A * 11/1991 Berry et al.
5,303,927 A * 4/1994 Perry et al.
5,529,306 A 6/1996 Staats et al.
5,577,729 A 11/1996 Sabour
5,893,803 A * 4/1999 Leadbetter et al.
5,895,328 A 4/1999 Pahio
6,095,930 A 8/2000 Siddall
6,176,790 B1 1/2001 Latella
6,325,727 B1 12/2001 Carr
6,331,168 B1 12/2001 Socci

* cited by examiner

*Primary Examiner*—Paul T. Sewell
*Assistant Examiner*—Nini F. Legesse
(74) *Attorney, Agent, or Firm*—Richard B. Main

(57) ABSTRACT

A golf-swing training device includes a neck strap for wearing about the neck of a golfer-under-training. A tether strap connects to a front part of the neck strap and has an adjustable length. A foot plate is connected to a distal end of the tether strap, and is intended to be held under a foot of the golfer-under-training. Such provides for the head and neck of the golfer-under-training to be held at a constant elevation during a swinging of a golf club. A clip may be attached to the middle of the tether strap and the clothing of the golfer-under-training so the tether strap will be kept close in and away from the swinging golf club.

1 Claim, 2 Drawing Sheets

GOLF-SWING TRAINING HARNESS

BACKGROUND OF THE INVENTION

1. Field of the Invention

The present invention relates to golf-swing training, and more particularly to methods and devices for training the users to keep their heads level during their stroke.

2. Description of Related Art

Hitting a golf ball straight and true is difficult and requires skill. Fundamentally, if the ball is to fly off the tee straight, the club that hits it must also be squarely aligned. This, of course, depends on how well the golfer has swung the club. Golf-swing training therefore has the goal of getting the golf balls to fly on the intended straight course, and to put enough power behind the contact to make the ball fly the required distance.

The prior art has approached golf-swing training in a number of different ways. John M. Siddall describes a mirror that attaches above the face of a golf club, in U.S. Pat. No. 6,095,930, issued Aug. 1, 2000. The mirror is set at 45-degrees and reflects the target downrange up to the golfer's eyes. A sight-hair indicates how square the club face is to the downrange target.

Theodore J. Staats describes a restraint that keeps the user's left pectoral muscle and right forearm at a constant separation distance, in U.S. Pat. No. 5,529,306, issued Jun. 25, 1996. The object is to develop a proper torso twist motion and proper geometry between the arms and body of the golfer during the swing.

Pete Pahio, in U.S. Pat. No. 5,895,328, issued Apr. 20, 1999, describes an accelerometer that attaches to the club to measure the centrifugal force developed during the swing. An audible signal is electronically generated at various preset force levels. Such allows a user to train for repeating a !particular golf-club swing speed. A consistent swing allows for greater control.

Frank A. Latella describes using large, soft balls held between the knees and under the arm pits of golfers to improve their swing, in U.S. Pat. No. 6,176,790 B1, issued Jan. 23, 2001. Holding the balls this way between the limbs is said to restrict movement during the swing and promote desirable muscle-group stretching and training.

The development of so-called muscle memory is described by John Carr, in U.S. Pat. No. 6,325,727 B1, issued Dec. 4, 2001. The viscosity of water in a swimming pool is used to slow down and increase resistance of a paddle that simulates a golf club. The increased effort required to swing this while neck-deep in water is used to work the corresponding muscles all that harder.

Some training devices have been directed to keeping the head of a golfer level during their swing. Roger David Socci describes a helmet in U.S. Pat. No. 6,331,168 B1, issued Dec. 18, 2001. Such helmet has electronic level sensors and will emit audible tones the golfer can use as positive or negative feedback.

A head movement detector for golf swing training is described by Max T. Sabour, in U.S. Pat. No. 5,577,729, issued Nov. 26, 1996. This device attaches a free-standing crane on a floor stand to a cap worn by the golfer-under-training. Excessive head movement during the swing is monitored and reported.

A very complex apparatus is described by G.M.T. Jenks, in U.S. Pat. No. 2,737,432, issued Mar. 6, 1956. A lot of machinery is attached to a golf club and the machinery swings the club through the correct arc. The golfer hangs on and tries to sense how a correct swing proceeds by feeling how the machine does it.

A golf training apparatus that is worn around the neck and connected to a floor plate held under both feet is described in two United States Patents. G. F. Fisher describes one in U.S. Pat. No. 3,442,513, issued May 6, 1969, that runs a cord from a noose around the neck, through a slip ring on the front of a waistbelt, through another slip ring on a floor plate, and back up to an anchor point on the waistbelt. The second patent, by Douglas Schaus, U.S. Pat. No. 3,677,551, issued Jul. 18, 1972, describes a base plate connected to a neck loop by a flexible link.

SUMMARY OF THE INVENTION

Briefly, a method and device embodiment of the present invention comprise wearing a harness that resembles a loosely worn necktie with a long tether down to a footplate. The tether length is adjusted for the desired neck and head level of the golfer while standing on the footplate. Then during a golf-club swing, the device restrains the user from lifting their neck and head too high. It also will slacken when the neck and head have dropped too low. The slack and tension are used by the golfer as feedback to develop a correct swing by keeping the neck and head level throughout. After a number of repetitions with the device, the golfer is thereafter able to repeat the control and discipline learned without restraint. A better golf performance results.

An advantage of the present invention is a method and device are provided for improved golf performance.

Another advantage of the present invention is that a method and device are provided that are simple, inexpensive, and effective.

A still further advantage of the present invention is that a golf-swing training device is provided that is compact, light, and easy to carry.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
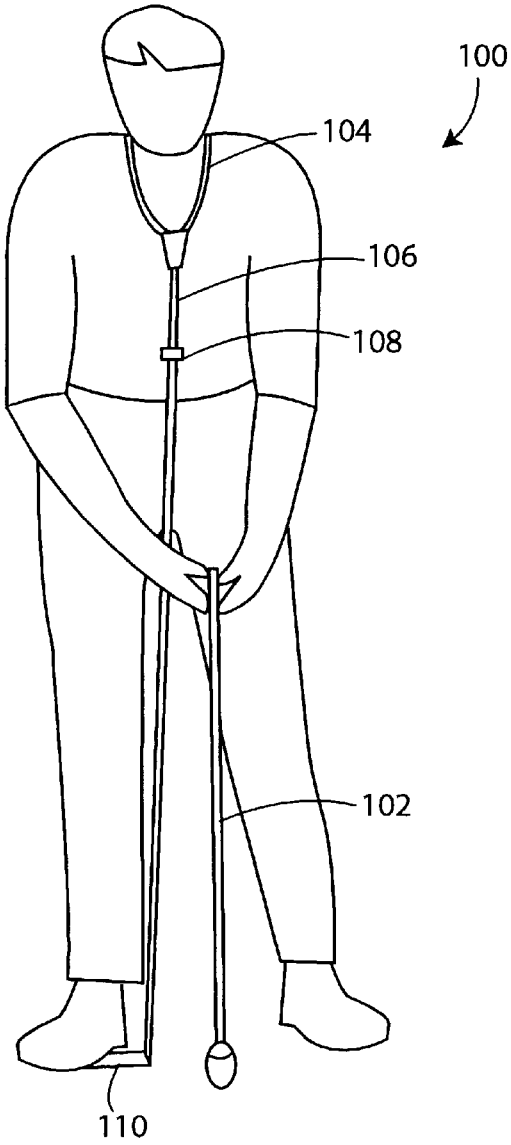
FIG. 1 is a diagram of a golfer wearing/using a golf-swing training device embodiment of the present invention.

FIG. 1 illustrates a method of golf-swing training 100 and a golfer swinging a golf club 102. The golfer is learning to swing the club properly by learning to keep neck and head at a constant level elevation above the ground during the swing. A device to help learn this is worn around the neck like a loose-fitting necktie. A neck strap part 104 is gathered at the front and connected to a tether strap part 106. A clip 108 is used to keep the tether strap part 106 out of the way of the swing by attaching it to the golfer's clothing, e.g., a shirt. A simple alligator-clip or clothes-pin type is suitable. A foot plate 110 is attached to the distal, bottom end of tether strap part 106. Such footplate may be slipped into the golfer's pocket while walking between shots.

In use, the golfer steps on foot plate 110 and adjusts the length of tether strap part 106 to arrive at a suitable neck and head elevation. For example, the golf setup position. Preferably, the footplate 110 is held under the right heel for a right-handed golfer. The golfer practices repeatedly while wearing the golf-swing training device to swing the club 102 straight and true. A light steady pressure of the neck on the neck strap part 104 is recommended during the back swing to keep the head level. As the forward swing commences, the golfer's weight is shifted to the left foot and off the right foot. The footplate 110 is then automatically released for the follow through swing just before impact with the golf ball.

After some amount of conditioning and muscle-memory development, the golfer may then play golf without the device and with improved skill and performance.

Figure 2:
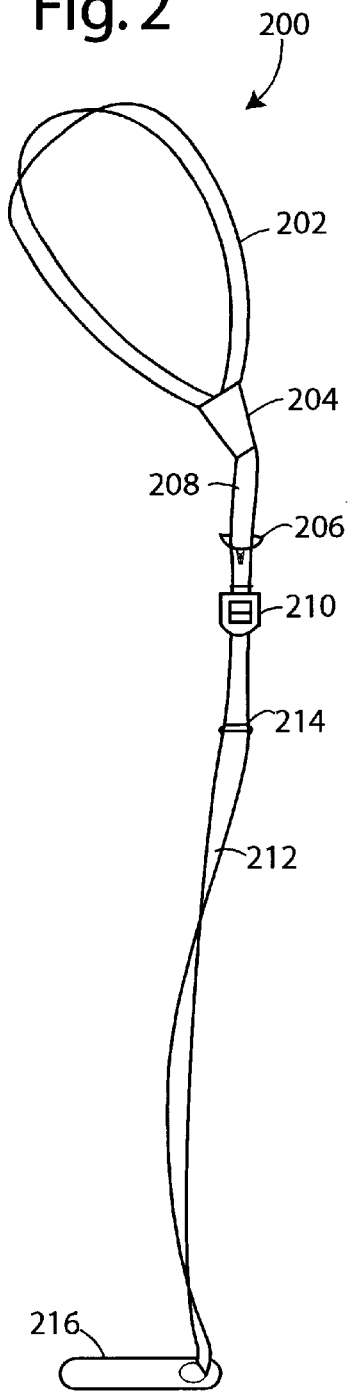
FIG. 2 is diagram of a golf-swing training device embodiment of the present invention.

FIG. 2 illustrates another golf-swing training device embodiment of the present invention, and is referred to herein by the general reference numeral 200. Such is similar to that shown in FIG. 1. The golf-swing training device 200 comprises a nylon-web belt construction. A neck strap 202 is sewn into a loop at knot 204. A clothes clip 206 slides on an upper tether strap 208 attached to the knot 204. An adjustment buckle 210 is sewn to the bottom end of upper tether strap 208. A lower tether strap 212 is passed up and through the adjustment buckle 210 and a loose end is captured by a slip ring 214. A relatively heavy plastic or metal footplate 216 is tied, sewn or otherwise attached to the bottom end of lower tether strap 212.

In one instance, a golf-swing training method embodiment of the present invention comprises wearing a harness that resembles a loosely worn necktie with a long tether down to a footplate. The length of the tether is adjusted for a desired neck and head level of the golfer while standing with one foot on the footplate. The user is restrained from lifting their neck and head too high during a golf swing by tension on the tether. The tether automatically slackens when their neck and head have dropped too low. A correct golf swing is developed by using the slack and tension as feedback to keep the neck and head level throughout. Repeating such wearing for a number of times is preferred until the golfer is thereafter able to repeat any control and discipline learned without restraint for a better golf performance.

Figure 3:
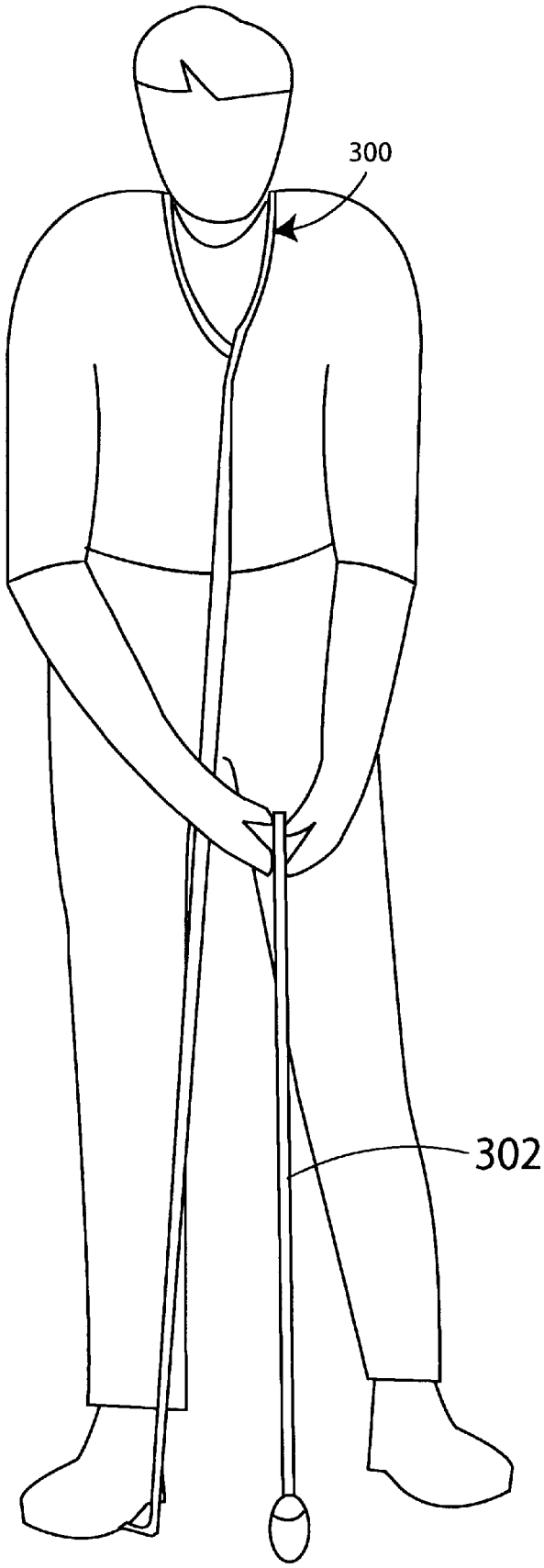
FIG. 3 is a diagram of a golfer wearing/using a highly simplified golf-swing training device embodiment of the present invention.

In FIG. 3, a golf-training device 300 shows how implementations of the present invention can be highly simple and reduced to their most critical constituent parts. Such golf-training device 300 is a soft rope or cord with a loop or noose. The bottom end, e.g., distal end, is simply stepped upon at an appropriate point. For example, a golfer with a club 302 takes their stance and steps on the end of the cord to snug the level of the golfer's neck and head. During the swing, just before contact, the golfer shifts their weight to release the bottom end. This allows the follow through and a rise in the neck and head level.

The materials used in the construction of the neck straps and tethers can be any commonly used belting. for example, leather. The prototypes that were constructed used nylon webbing similar to ordinary automobile seat belts. In use, the devices should be light-weight, comfortable, easy to keep clean and attractive.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. A method of golf-swing training, the method comprising the steps of:

wearing a harness that resembles a loosely worn necktie with a long tether directly down to and terminating at a footplate;

adjusting the length of said tether for a desired neck and head level of a golfer while standing with one foot only on said footplate;

restraining said golfer from lifting their neck and head too high during a first part of a golf swing by tension on said tether up until about the point contact is made with a golf ball during said golf swing and then releasing for a second, follow-through part of said golf swing;

slackening said tether when their neck and head have dropped too low;

developing a correct golf swing by using slack and tension on said tether as feedback to keep the neck and head level during said first part of said golf swing; and repeating the wearing for a number of repetitions until said golfer is thereafter able to repeat any control and discipline learned without restraint for a better golf performance.

* * * * *